United States Patent [19]

Aubert

[11] Patent Number: 4,797,232

[45] Date of Patent: Jan. 10, 1989

[54] PROCESS FOR THE PREPARATION OF A BOROSILICATE GLASS CONTAINING NUCLEAR WASTE

[75] Inventor: Bruno Aubert, Marignan, France

[73] Assignee: Societe Generale pour les Techniques Nouvelles, Paris, France

[21] Appl. No.: 35,051

[22] Filed: Apr. 6, 1987

[30] Foreign Application Priority Data

Apr. 8, 1986 [FR] France ..... 86 05010

[51] Int. Cl.[4] ..... G21F 9/16; G21F 9/14

[52] U.S. Cl. ..... 252/629; 252/632; 501/12; 501/152; 501/155

[58] Field of Search ..... 252/629, 632; 501/12, 501/152, 153, 154, 155; 106/74; 423/326, 328, 329

[56] References Cited

U.S. PATENT DOCUMENTS

| | | | |
|---|---|---|---|
| Re. 32,107 | 4/1986 | January | 501/12 |
| 4,202,792 | 5/1980 | Kaufmann et al. | 252/629 |
| 4,376,070 | 3/1983 | Pope et al. | 252/629 |
| 4,377,507 | 3/1983 | Pope et al. | 252/629 |
| 4,422,965 | 12/1983 | Chickering et al. | 252/629 |
| 4,424,149 | 1/1984 | Bege et al. | 252/629 |
| 4,472,510 | 9/1984 | January | 501/12 |
| 4,514,329 | 4/1985 | Wakabayashi et al. | 252/629 |
| 4,664,895 | 5/1987 | McDaniel | 423/277 |

FOREIGN PATENT DOCUMENTS

| | | |
|---|---|---|
| 0168218 | 1/1986 | European Pat. Off. . |
| 2611689 | 9/1977 | Fed. Rep. of Germany . |
| 1050818 | 12/1966 | United Kingdom . |

*Primary Examiner*—Howard J. Locker

*Attorney, Agent, or Firm*—Marshall & Melhorn

[57] ABSTRACT

The invention relates to a process for the preparation of a borosilicate glass containing nuclear waste.

In this process, an inactive borosilicate matrix is prepared in an aqueous medium by mixing the following:

a silica-based gel precursor, a concentrated aqueous solution of a boron compound, and a concentrated aqeuous solution of the vitrification adjuvant, in proportions corresponding to the composition of the final glass minus the waste, with stirring at a high rate of shear, at a temperature of between 20° C. and 80° C., preferably at 65°-70° C., at an acid pH, preferably a pH of between 2.5 and 3.5, so as to form a gelled solution, and the said matrix is heat-treated and the nuclear waste is added at any stage during the said treatment to form, by melting, the final borosilicate glass containing the said waste.

The process according to the invention is applied to the treatment of nuclear waste, especially to solutions of fission products.

21 Claims, No Drawings

PROCESS FOR THE PREPARATION OF A BOROSILICATE GLASS CONTAINING NUCLEAR WASTE

High-level nuclear waste, such a fission products, or nuclear waste with a long half-life, such as actinides, is currently immobilized in borosilicate glasses which offer adequate safety guarantees to man and the environment.

The Atomic Energy Commission (AEC) has developed an industrial process for the vitrification of fission products (FP).

This process (called AVM) consists in calcining the solution of FP and sending the resulting calcinate, at the same time as a glass frit, into a melting furnace.

A glass is obtained in a few hours, at a temperature of the order of 1100° C., and is run into metal containers.

The glass frit is composed mainly of silica and boric oxide together with the other oxides (sodium, aluminum etc.) necessary so that the total formulation of calcinate+frit gives a glass which can be produced by the known glassmaking techniques and which satisfies the storage safety conditions (conditions pertaining to leaching, mechanical strength, etc.).

In the melting furnace, the calcinate is digested and becomes incorporated into the vitreous structure. The chosen temperature must be sufficiently high to hasten the digestion, but must not have an adverse effect on the life of the furnace.

To limit this disadvantage, the Applicant Company developed a process in which the constituents of the glass are mixed in an aqueous medium to form a gelled solution, instead of preparing the glass from solid consitutents in the form of oxides.

Furthermore, it is known that a glass can be obtained from a gelled solution (or by the so-called "gel method") at temperatures below those required with oxides ("oxide method"). The aim is essentially to manufacture, by the gel method, glasses having the same formulation as those currently prepared by the oxide method, as will be shown in the examples, but any borosilicate formulation acceptable for conditioning waste can be prepared.

In the remainder of the text, the following terms will be employed with the meanings defined below:

vitrification adjuvant: This comprises all the constituents of the final glass other than the constituents originating from the nuclear waste and except for B and Si. This adjuvant therefore contains no active nuclear components. In the AVM process, it is included in a glass frit; in the process forming the subject of the invention, it is an aqueous solution.

final glass: This is the glass in which the nuclear waste is immobilized.

sol: This is a solution of orthosilicic acid; the latter, being unstable, changes by polymerizing. Commericial sols, such as Ludoxϕ (du Pont de Nemours), are stabilized solutions containing partially hydrated particles of silica; these colloidal particles are polymers whose polymerization has been stopped but can be unblocked, for example by acidification.

gelled solution, or gel: This is a homogeneous solution of variable viscosity, ranging from a solution which flows to a solidified mass, depending on how far the polymerization has advanced.

A method, called the sol-gel method, is known for preparing gels in an aqueous medium; it consists in using a sol in water and destabilizing it by modifying the pH, thus causing this solution to gel.

The following publication refer to this method:

J. ZARZYCKI—J. of Materials Science 17 (1982) p 3371-3379

R. JABRA—Revue de Chimie Minérale, t. 16, 1979, p 245-266

J. PHALIPPOU—Verres et Réfractaires, Vol. 35, no. 6, Nov. Dec. 1981.

The preparation of an $SiO_2$—$B_2O_3$ glass by the sol-gel method is described in the literature:

addition of a solution of Ludox, adjusted to pH 2, to an aqueous solution of hydrated ammonium tetraborate, also adjusted to pH 2;

mixing by stirring for 1 hour (aqueous ammonia being added, if necessary, to bring the pH of the medium to 3.5, which is very favorable for gelling); if the resulting solution shows no precipitation or flocculation, it is considered to be a satisfactory gel;

drying for 8 hours at 100° C. and then for 15 h at 175° C. under a vacuum of 0.1 mm Hg; and hot pressing (450 bar—500° to 900°—15 min to 5 hours) in order to densify and vitrify the product (an alternative method is melting).

Only binary or ternary glasses have so far been prepared by this method because the presence of a multiplicity of cations makes it difficult to control gelling and even to achieve it.

Thus, to produce a glass having the same composition as the glass frit used in the present vitrification process, the following would be necessary:

$B_2O_3$, $SiO_2$, $Al_2O_3$, $Na_2O$, ZnO, CaO, $Li_2O$, $ZrO_2$.

Now, it is known that:

boron makes gelling very difficult (in the HITACHI process described below, boron is actually added after the gel has formed), particularly because of the high insolubility of a large number of boron compounds, and favors recrystallization in mixed gels;

aluminum favors precipitation to the detriment of gellling, which opposes the desired result; and sodium, calcium and zirconium lead to the formation of crystals which subsequently constitute fragile points capable of causing local destruction.

Due to the multiplicity of components, those skilled in the art are questioning the method of introducing them and the order in which they are introduced.

The complexity of the components in the vitrification process, namely:

those of the virtrification adjuvant ($Al_2O_3$, $Na_2O$, ZnO, CaO, $Li_2O$, $ZrO_2$) plus $B_2O_3$ and $SiO_2$, and at the same time those of the solution of FP to be vitrified (around twenty different cations), led industrialists to develop two processes based on gels:

(1) Westinghouse and the US Department of Energy developed a process for the vitrification of active solutions involving the preparation of gels, but in an alcoholic medium (alcogels)—U.S. Pat. No. 4,430,257 and U.S. Pat. No. 4,422,965. Their process can be summarized in the following way:

mixing and hydrolysis of the inactive constituents of the gel in an alcohol/water medium, the constituents being introduced in the form $X(OR)_n$, for example $Si(OR)_4$, $B(OR)_3$ etc., R being an organic radical or a proton;

removal of the water/alcohol azeotrope to give a dry gel;

addition of the solution of nuclear waste (the final compound containing a maximum of 30–40% of waste), adjusted to pH 4 to 6;

drying; and melting.

The gel prepared from comopunds $X(OR)_n$ in an alcoholic medium can be obtained more easily because solubility problems are avoided and, furthermore, the peptizing effect of water at high temperature is eliminated by using alcohol.

The major disadvantage of this type of process is that the alcoholic medium is prone to fire, explosion etc., so the alcohol has to be removed before introduction of the nuclear waste; this necessitates an additional operation which is rather impractical to carry out.

(2) The HITACHI process, in which the gel is obtained from the solution of FP in a solution of sodium silicate, the boron (in the form of $B_2O_3$) not being added until after gelling; this necessitates calcining the gel at 600° C., or above, for the time required for the boron to diffuse into the silicate matrix to form the borosilicate structure (for example 3 h); the homogeneity of the product remains a problem.

Publication: N. UETAKE—Nuclear Technology, Vol. 67, Nov. 1984

The Applicant Company has developed a process for the immobilization of nuclear waste which does not have the disadvantages of the Westinghous and Hitachi processes and in which a borosilicate matrix is prepared in an aqueous medium, the nuclear waste is subsequently added to the said matrix at any stage during its treatment, and this mixture is then heat-treated to give a borosilicate glass.

This process therefore has the advantages of working in an aqueous medium and adding the boron at the precise moment when the gelled matrix is formed, the boron thus participating in the structure of the gelled matrix, which is why the latter is called a borosilicate matrix.

In the process forming the subject of the invention, the borosilicate matrix is prepared by mixing the following:

a silica-based gel precursor, a concentrated aqueous solution of a boron compound, and a concentrated aqueous solution of the vitrification adjuvant, in proportions corresponding to the composition of the final glass minus the waste, with stirring at a high rate of shear, at a temperature of between 20 and 80° C. (preferably at 65°–70° C.) and at an acid pH, preferably a pH of between 2.5 and 3.5, so as to form a gelled solution, the said inactive matrix is heattreated and the nuclear waste is added at any stage during the said treatment in order to form, by melting, the final borosilicate glass containing the said waste.

In the account of the process, the term "gel precursor" will be used to denote a substance containing particles of silica which may be partially hydrolyzed; it is either in the form of a powder, which can produce a sol when dissolved in acid solution, or directly in the form of a sol.

Examples of gel precursors which are sold commerically and are advantageously used in the process are a sol such as Ludox® (du Pont de Nemours) or alternatively Aerosil® (Degussa), which is formed by the hydrolysis of silicon tetrachloride in the gas phase. In an acid medium, Aerosil produces a sol and then a firm gelled mass.

Ludox is used as it is, in solution. Aerosil, on the other hand, can be used either directly in the form of a powder introduced into the mixture (depending on the technology employed, especially with regard to stirring), or in solution.

Furthermore, the gel precursor can consist of a mixture of gel precursors; for example, the silica will be introduced as Ludox and Aerosil in one and the same operation.

The gel precursor is placed in an acid aqueous medium, in accordance with the process forming the subject of the invention, so that it is converted to a gelled solution by polymerization starting from the Si—OH bonds.

The boron required to form the borosilicate structure is introduced as an aqueous solution of a sufficiently soluble boron compound. This can be for example ammonium tetraborate (ATB), which has a satisfactory solubility between 50° and 80° C. (about 300 g/l, i.e., 15.1% of $B_2O_3$). Preferably, the solution is produced and used at 65°–70° C. Boric acid can equally well be employed; its solubility is 130 g/l at 65°, i.e. 6.5% of $B_2O_3$.

The solutions used (boron compound and vitrification adjuvant) are prepared as concentrated solutions so that a gel is produced quickly and the quantity of water to be evaporated off is minimized, as will be explained in the description and the examples. It is difficult to give an exact concentration limit for each of the compounds, but the concentration of the solutions can reasonably be given as at least 75% of the saturation concentration.

The compounds, containing the desired elements, which are used to prepare the solution of the adjuvant should be soluble in water at the temperature of the process, be mutually compatible and not add other ions unnecessarily, and their ions which do not participate in the structure of the final glass should be easy to eliminate by heating. An example would be solutions of nitrates in cases where nitric acid solutions of FP are being treated. Solid compounds are preferably dissolved in the minimum amount of water so as to minimize the volumes treated and the amounts of water to be evaporated off.

The proportions in which these solutions (except for the solutions of waste) are prepared and mixed depend on the desired formulation of the final glass. It can be considered that the constitutent components of the glass can not volatilized in practice and that the resulting composition of the final glass virtually corresponds to that of the mixture produced. An acceptable glass formulation is indicated in the examples. The qualitative and quantitative composition of the vitrification adjuvant is adapted according to the composition of the final glass and that of the solution of waste to be treated.

The mixture is prepared at between 20° and 80° C. The concentrated solution of the boron compound is kept at between 50° and 80° C. in order to prevent precipitation. The other solutions are produced at ambient temperature. It is then possible either to mix the solutions at the temperature at which they are produced or arrive, or to heat all the solutions to a higher temperature.

The latter case has the following advantage. After mixing has taken place and the gelled solution has started to form, polymerization (gelling) develops over a so-called ageing period. This is favored by raising the temperature. It is therefore very advantageous to produce the mixture at between 50° C. and 80° C. In the process forming the subject of the invention, the ageing of the gelled solution takes place during drying, preferably at 100°-105° C.

The solutions of the constituents of the glass have different pH values: the gel precursor in solution is alkaline (Ludox) or acid (Aerosil in nitric acid solution), the solution of vitrification adjuvant is acid and the solution of boron compound is acid (boric acid) or alkaline (ATB).

In the process described here, the pH of the mixture must be below 7 and preferably between 2.5 and 3.5. The pH can be adjusted if necessary.

For the solutions employed, the components are as follows:

| | % of oxide constituents of the glass | Temperature |
|---|---|---|
| A Gel precursor | a% of $SiO_2$ | 25° to 80° C. |
| B Boron solution | b% of $B_2O_3$ | 50° to 80° C. |
| C Vitrification adjuvant | d% of oxides | 50° to 80° C. |

In the process forming the subject of the invention, the components are mixed by being introduced simultaneously and being stirred at "a high rate of shear". These components can be introduced separately or, if they do not react with one another, they can be introduced together.

The expresiion "a high rate of shear" is used to qualify stirring which is effected by a device rotating at a minimum of 500 rmp, preferably 2000 rpm, and for which the thickness of the stirred layer (distance between the stirrer blade and the wall of the mixing zone) does not exceed 10% of the diameter of the blade.

This stirrer can be a turbine, for example for industrial-scale application. Laboratory tests with a mixer or a mechanical stirrer in a narrow beaker demonstrated an adequate mixing capacity.

In the present state of knowledge, there is every reason to think that the stirring must be the more intense and hence the shorter, the greater the risks of precipitation. What is actually required is to create a homogeneous mixture, by stirring, in a time which is very short compared with the precipitation time, and to ensure that the gel forms as quickly as possible so as to solidify the various ions and, by preventing any diffusion of these ions, prevent a possible reaction between the said ions.

In the process forming the subject of the invention, an important advantage not formerly obtained by the other gelling techniques is that large quantities of gel can be prepared without difficulty. With a turbine, 40 kg/h of gel was reached very easily, and this does not represent the limit.

Mixing produces a solution called a gelled solution, its viscosity and texture changing with time and ranging from those of a fluid solution to those of a gel.

When mixing is effected at a high rate of shear, the phenomenon of thixotropy occurs, the viscosity drops and a homogeneous dispersion of particles is produced. When not stirred, the viscosity of this mixture increases and the ions trapped in the structure can no longer react; the structure "freezes".

The inactive borosilicate matrix thus obtained in the form of a gelled solution is then heat-treated, the nuclear waste being added at any stage during the said treatment.

Different possibilities for inclusion of the nuclear waste will now be examined.

The process can be applied to various types of solid and/or liquid nuclear waste. It is particularly suitable for the vitrification of solutions of FP by themselves or with other active effluents, for example the soda solution for washing the tributyl phosphate used to extract uranium and plutonium, it even being possible for this soda solution to be treated on its own by this process.

The solutions of FP are nitric acid solutions originating from reprocessing of the fuel; they contain a large number of elements in various chemical forms and a certain amount of insoluble material. An example of their composition is given below.

The soda effluent is based on sodium carbonate and contains tributyl phosphate (TBP) degradation products entrained by the washing process (Example 2). The high level of sodium in this effluent has to be taken into account when determining the composition of the borosilicate matrix.

1st case: The nuclear waste in solution is added to an inactive borosilicate matrix whose volume has been reduced.

The gelled solution obtained by mixing the constituents under the conditions described is dried at between 100° and 200° C., preferably at 100°-105° C. During this operation, the water evaporates off and the volume is reduced. For the remainder of the process, it is possible either to carry out thorough drying to give a friable solid product, or simply to make do with a volume reduction—more quickly achieved—of 25 to 75% of the initial volume so as to give a paste.

The resulting matrix of reduced volume is dispersed and mixed by stirring with the solution of nuclear waste to be treated. It can be advantageous to mix the components at a temperature of between 60° and 100° C. so as to reduce the volume of water at the same time as effecting mixing.

In another embodiment, the dried matrix is introduced into the calciner, the solution of waste is introduced simultaneously into this calciner and mixing takes place in the calciner, which rotates about its longitudinal axis. The produce obtained is sent directly to the melting furnace.

Whichever embodiment is used, the process has the same characteristics: preparation of the matrix—drying—addition of the waste—heat treatment ranging from a drying temperature to a melting temperature (drying-calcination-melting).

The mixture obtained is dried if necessary (at between 100° and 200° C., preferably at 100°-105° C.), for example in an oven; drying in vacuo is a further possibility. After drying, calcination is carried out at between 300° and 500° C. (preferably at 350° to 400° C.), during which the water finishes evaporating off and the nitrates partially decompose.

Calcination can be carried out either in a conventional calciner (of the type used in the AVM process) or in a melting furnace, for example of the ceramic melter type.

The decomposition of the nitrates is always terminated during melting. On entering the furnace, the product rapidly passes from its calcination temperature to its melting point. This is the so-called introduction zone. Then, in the so-called refining zone, it is at a temperature slightly above the melting point and then at the pouring temperature. The value is advantageously between 1035° C. and 1100° C., at which the viscosity of the glass, between 200 poises and 80 poises, enables the glass to be poured under good conditions.

The melting point of the mixture depends on the composition of the said mixture. In fact, sodium improves the fusibility of glasses, but has the disadvantage of lowering their resistance to leaching.

Also for the purpose of immobilizing nuclear waste, the AEC has produced a glass formulation which satisfies the nuclear safety conditions and can be treated by the known glassmaking techniques in accordance with the so-called oxide method.

When a mixture having the AEC formulation is prepared in an aqueous medium by the so-called gel method, the refining times are found to be shorter than those required in the so-called oxide method. The throughputs of the furnace can therefore be increased.

Furthermore, the process forming the subject of the invention makes it possible to vitrify various types of waste, in particular sodium-rich waste, since the composition of the borosilicate matrix is adjusted to the type of waste treated. Thus, for sodium-rich waste, a low-sodium (or even sodium-free) borosilicate matrix is prepared, as will be shown in the examples.

In this way, the formulation produced by the AEC, which is highly satisfactory, can easily be obtained with diverse types of waste; other formulations which would be acceptable could equally well be prepared.

The drying-calcination-melting steps described correspond to heat treatments in defined temperature zones. Similar heat treatments in other devices are obviously suitable, as is in general any technique for producing glass from the gel.

2nd case: The nuclear waste in solution is added to a calcined borosilicate matrix.

The borosilicate matrix in the form of a gelled solution is dried (at between 100° and 200° C., preferably at 100°-105° C.) and then calcined at between 300° and 500° C., preferably at a temperature below 400° C., in devices similar to those described for the 1st case.

With a calcination temperature below or equal to 400° C., the gel obtained is friable, which facilitates its dispersion in the solution of waste; furthermore, this gel has a maximum specific surface area in this zone; above 400° C., sintering in fact begins and closes the pores.

The calcined matrix obtained is dispersed and mixed with the solution of waste to be treated.

As previously, the operation is advantageously carried out above 60° C., preferably at 100°-105° C., so as to dry while mixing.

This operation of mixing the calcined matrix with the solution of waste can be carried out in a reactor or alternatively in the calciner itself. In the latter case, the calciner is fed with the solution of FP and the calcined matrix introduced separately in the desired proportions. Consequently, the operation takes place at nearly 200° C. at the entrance of the calciner. the temperature rising to about 400° C.

In a reactor, the substances are mixed by means of a stirrer; in a calciner, mixing is effected by the rotation of the calciner itself about its longitudinal axis.

The mixture obtained (calcined matrix+waste) is subjected to a heat treatment (drying, calcination, melting) under the conditions already described for forming a glass.

3rd case: The waste is in solid form.

Consideration has been given to the case where the nuclear waste in solution was aded to the calcined borosilicate matrix. It is just as feasible to introduce the waste in solid form, for example as a calcinate.

This process has the advantage that it can be implemented immediately in present-day production lines, making it possible to adapt the vitrification adjuvant to the waste treated (as will be shown in Example 3).

It is also possible to add the waste in solid form, for example as a calcinate, to the dried matrix.

The examples which follow will illustrate the invention.

Example 1: 1st case

The solutions

On the laboratory scale, a solution of FP was simulated using a typical composition of a real solution of FP in the following manner:

| | Product used | Quantity (g) | Corresponding quantity of oxide (g) |
|---|---|---|---|
| 1- | $Al(NO_3)_3.9H_2O$ | 117.6 | 15.9 |
| | $Fe(NO_3)_3.9H_2O$ | 146.7 | 29 |
| | $Ni(NO_3)_2.6H_2O$ | 19.4 | 5 |
| | $Cr(NO_3)_2.9H_2O$ | 26.3 | 5 |
| | $Na_4P_2O_7.10H_2O$ | 9.4 | 5.6 |
| | $NaNO_3$ | 103.6 | 37.7 |
| 2- | $Sr(NO_3)_2$ | 6.7 | 3.2 |
| | $CsNO_3$ | 15.2 | 10.9 |
| | $Ba(NO_3)_2$ | 9.7 | 5.6 |
| | $ZrO(NO_3)_2.2H_2O$ | 34.7 | 15.9 |
| | $Na_2MoO_4.2H_2O$ | 26.4 | 22.5 |
| | $Co(NO_3)_2.6H_2O$ | 5.8 | 1.4 |
| | $Mn(NO_3)_2.4H_2O$ | 27.7 | 9.5 |
| | $Ni(NO_3)_2.6H_2O$ | 18.3 | 4.6 |
| | $Y(NO_3)_3.4H_2O$ | 5.5 | 1.7 |
| | $La(NO_3)_3.6H_2O$ | 23.7 | 8.8 |
| | $Ce(NO_3)_3.6H_2O$ | 24.9 | 9.3 |
| | $Pr(NO_3)_3.4H_2O$ | 10.6 | 4.3 |
| | $Nd(NO_3)_3.6H_2O$ | 39.6 | 15.1 |
| | $ZrO_2$ | 4.6 | 4.6 |
| | Mo | 3.5 | 5.3 |
| | $U_3O_8$ | 8.8 | 8.5 |

Group 1 represents the inactive components of the solution of FP and group 2 simulates the active components of this same solution and the insoluble materials.

$ZrO_2$ and Mo remain solid; they simulate the insoluble materials suspended in the solution. The total quantity of water added is 2972 g. The simulated solution of FP has a pH of 1.3.

The composition of the final glass to be obtained is:

| Composition of the glass | | introduced via |
|---|---|---|
| $SiO_2$ | 45.5% | Ludox |
| $B_2O_3$ | 14% | Solution of ATB |
| $Al_2O_3$ | 4.9% | Solution of adjuvant and simulated solution of FP |
| $Na_2O$ | 9.8% | Solution of adjuvant and simulated solution of FP |
| ZnO | 2.5% | Solution of adjuvant and simulated solution of FP |
| CaO | 4.1% | Solution of adjuvant and simulated solution of FP |
| $Li_2O$ | 2% | Solution of adjuvant and simulated solution of FP |
| Active oxides | 13.2% | Simulated solution of FP |
| $Fe_2O_3$ | 2.9% | " |

-continued

| Composition of the glass | | introduced via |
|---|---|---|
| NiO | 0.4% | " |
| $Cr_2O_3$ | 0.5% | " |
| $P_2O_5$ | 0.3% | " |

In the percentage composition shown, it is necessary to allow for the presence of Na and Ni in the active oxides (group 2 of the solution of FP defined above).

Thus, the solution of the vitrification adjuvant is prepared according to the composition of the glass to be obtained and the composition of the solution of waste to be treated.

For this example, the solution of vitrification adjuvant is prepared as follows:

| Product used | Quantity (g) | Corresponding quantity of oxide (g) |
|---|---|---|
| $Al(NO_3)_3.9H_2O$ | 243.6 | 33.1 |
| $NaNO_3$ | 148.4 | 54.1 |
| $Zn(NO_3)_2.6H_2O$ | 91.4 | 25 |
| $Ca(NO_3)_2.4H_2O$ | 170.1 | 40.4 |
| $LiNO_3$ | 91.4 | 19.8 |

Each of the compounds is dissolved in the minimum quantity of water, i.e. a total of 640 g of water at 65° C.; pH: 0.6.

The precursor is Ludox AS40: 40% $SiO_2$/60% $H_2O$; $\phi$ of the particles: 21 nm; $d_{25°C}$: 1.30; pH: 9.3; used at ambient temperature.

The ATB solution is 265.2 g of $(NH_4)_2O.2B_2O_3.4H_2O$ dissolved in 663 g of water at 65° C.; pH: 9.2.

The device

The device used is a conventional turbine having a mixing zone of small volume, in which a propeller with several blades rotates so as to effect mixing at a high rate of shear. It rotates at 2000 rpm in this example.

The turbine used for the tests is manufactured by the Company STERMA, the mixing zone has a volume of 1 $cm^3$ and the thickness of the stirred layer is of the order of mm.

The procedure

The solutions arrive at the turbine separately and simultaneously:

| | pH | T° | Flow rate at T° | Composition of the solution |
|---|---|---|---|---|
| Ludox | 9.3 | 20° C. | 12 kg/h | 40% of $SiO_2$ |
| Ammonium tetraborate.$4H_2O$ (ATB) | 9.2 | 65° C. | 9.9 kg/h | 21% of anhydrous salt, i.e. 15% of $B_2O_3$ |
| Solution of vitrification adjuvant | 0.6 | 65° C. | 14.7 kg/h | 40% of anhydrous salt, i.e. 12% of oxides |

36.5 kg/h of borosilicate matrix are thus prepared. 1.7 kg are spread over a plate with an average thickness of 2 cm and then placed in an oven at 100°-105° C. for 48 hours; 0.6 kg of dry matrix is obtained.

1.6 l of simulated solution of FP are placed in a 3 l container equipped with a rotating mechanical stirrer; the dried matrix is poured in uniformly, with stirring.

The mixture obtained is stirred for about 30 min and then dried at 100°-105° C. in an oven on a plate, calcined for 2 h at 400° C. and finally melted for 5 h at 1050° C. The glass obtained (0.5 kg) satisfies the criteria of acceptability.

In the tests, a glass of good quality was defined as being a homogeneous glass having no unmelted regions and no bubbles and also showing no traces of molybdate on the surface.

The molybdate originating from the solutions of FP actually presents a major problem: part of the active Mo tends to separate out from the solution and deposit, so this phase is not completely dispersed in the mixture and hence is not totally included in the gelled solution. Furthermore, when it diffuses poorly, the molybdenum appears on the surface of the glass in the form of visible yellow traces of molybdate, which are considered to be an indication of inferior quality glass.

Chemical analysis of the glass obtained further shows that the components are not volatilized in practice, so it can be considered that the composition of the mixtures (borosilicate matrix, then matrix+waste) virtually corresponds to that of the final glass.

Example 2: 2nd case

Test 1

3.7 kg of the borosilicate matrix coming from the turbine (preparation according to Example 1) are dried for 20 hours at 100°-105° C. on plates in an oven. The dried matrix is then placed in a furnace in which the temperature is gradually raised to 350° C. over 2 hours, and calcination is carried out for 2 h at 350° C. The product obtained is friable and is in the form of fragments of a few mm in diameter (on average 2-3 mm).

The calcined matrix (1 kg) is ground ($\simeq$300-400 $\mu$) and dispersed in the solution of FP (3 kg), simply with stirring (magnetic stirrer, 30-45 min). The mixture is calcined for 4 h at 400° C. after being heated for 34 h at 120° C., and is then melted at 1125° C.

40 min in the introduction zone and 1 h in the refining zone lead to a glass of good quality.

Test 2:

This test relates to the treatment of the soda effluent used for washing, which is subsequently acidified.

At present, in the vitrification (AVM) process based on the oxides, it is not easy to treat this effluent on its own.

This AVM process actually uses the vitrification adjuvant in the form of a solid glass frit, a known composition being:

| | | |
|---|---|---|
| $SiO_2$ | 55-60% | by weight |
| $B_2O_3$ | 16-18 | by weight |
| $Al_2O_3$ | 6-7 | by weight |
| $Na_2O$ | 6-7 | by weight |
| CaO | 4.5-6 | by weight |
| ZnO | 2.5-3.5 | by weight |
| $Li_2O$ | 2-3 | by weight |

If this composition were used to vitrify the soda effluent, the glass obtained would be very rich in sodium.

One might consider reducing the level of sodium in the glass frit, even to zero, so that the final glass (frit+calcinate of soda effluent) has an acceptable sodium level (9 to 11% by weight). However, one is then faced with the difficulty of producing and melting a glass which is poor in sodium (and consequently richer in silica).

The present invention makes it possible to produce, with the soda effluent, a borosilicate glass having a composition similar to that which proves totally satisfactory in the AVM process. Moreover, the refining temperature can be considerably lowered or the refining times shortened.

For tests, a soda solution was therefore simulated using 100 g of $Na_2CO_3$ in one liter of water. The ATB solution contains 312 g/l of ATB.$4H_2O$. The boric acid solution contains 130 g/l (6.5% of $B_2O_3$)−pH=2.7.

To obtain a glass having a composition similar to that obtained by the AVM process, the following solution of vitrification adjuvant is prepared (amounts are per liter of aqueous solution):

| | |
|---|---|
| $Al(NO_3)_3.9H_2O$ | 209.0 g |
| $Ca(NO_3)_2.3H_2O$ | 98.5 g |
| $LiNO_3$ | 53.7 g |
| $Zn(NO_3)_2.6H_2O$ | 49.7 g |
| $Fe(NO_3)_3.6H_2O$ | 73.5 g |
| $Mn(NO_3)_3.6H_2O$ | 18.2 g |
| $Ba(NO_3)_2$ | 5.5 g |
| $Co(NO_3)_2.6H_2O$ | 11.3 g |
| $Sr(NO_3)_2$ | 4.1 g |
| $CsNO_3$ | 8.0 g |
| $Y(NO_3)_3.4H_2O$ | 71.0 g |
| $Na_2MoO_4.2H_2O$ | 16.6 g |
| Monoammonium phosphate | 2.8 g |

The components Fe, Mn . . . phosphate were introduced into this solution so as to give a final glass with a composition similar to that given in the previous examples.

On the other hand, Aerosil®, marketed by the firm DEGUSSA, will be used instead of Ludox AS40 as the gel precursor. The gel precursor is formed by pouring the Aerosil gradually, with stirring, into water acidified with 3 N $HNO_3$ (pH: 2.5), so as to give a solution containing 150 g of silica per liter.

3 diaphragm pumps are provided, which have been adjusted beforehand to give the desired flow rates.

The following solutions are pumped simultaneously into a high-speed mixer (capacity: 1.5 liters) at the indicated flow rates and temperatures.

The set flow rates are:

ATB solution . . . 0.57 l/h at 65° C., or alternatively $H_3BO_3$ solution . . . 1.25 l/h at 65° C.

Adjuvant solution . . . 1.15 l/h at 65° C.

Aerosil solution . . . 2 l/h at 20° C.

The borosilicate matrix, obtained in the form of a gelled solution, is dried for 24 h at 105° C. and then calcined for 3 h at 350° C.. The solid particles taken from the furnace have a large specific surface area which varies from test to test but is always close to 50 $M^2/g$. After cooling, these particles are poured into the effluent to be treated and the mixture is stirred for 2 h. A gelatinous mass is formed, which is dried at 105°, calcined at 400° C. and finally melted at 1150° C.

Chemical analysis gives the following average composition:

| | |
|---|---|
| $SiO_2$ | 45.6% |
| $B_2O_3$ | 14% |
| $Na_2O$ | 10% |
| $Al_2O_3$ | 4.9% |
| CaO | 4% |
| $Li_2O$ | 2% |
| $Fe_2O_3$ | 2.9% |
| $MnO_2$ | 0.95% |
| BaO | 0.55% |
| CaO | 0.5% |
| $Cs_2O$ | 1% |
| SrO | 0.35% |
| $Y_2O_3$ | 4% |

-continued

| | |
|---|---|
| $MoO_3$ | 2% |
| $P_2O_5$ | 0.3% |

Example 3: 3rd case

Test 1

The following are introduced simultaneously into a 2 l mixer in ½ h:

ATB solution containing 15% of $B_2O_3$ at 0.75 l/h, or alternating $H_3BO_3$ solution containing 6.5% of $B_2O_3$ at 1.7 l/h Aerosil solution containing 150 g of $SiO_2$/l at 1.3 l/h Adjuvant solution containing 12% of oxides at 0.75 l/h 1.4 kg of mixture are obtained; this is dried at 100°-105° in an oven on a plate, then calcined for 3 h at 350° and finally melted.

320 g of this inactive calcined matrix are added to 135 g of a calcinate of FP and the two are roughly mixed. A melting time of 2 h at 1100° C. is required to give 300 g of a glass of the desired composition (that of Examples 1 and 2).

This example shows that it is possible to prepare a calcined gel having the same composition as the glass frit used in the AVM process.

Test 2

Here it is desired to vitrify a mixture of solution of FP+soda effluent.

This is done by preparing a calcined matrix having a composition similar to the glass frit of the AVM process, except for the sodium: the sodium oxide level is reduced from 7% to 2.6%.

The solution of vitrification adjuvant will have the following composition:

| Product used | Quantity in grams | Corresponding weight of oxide |
|---|---|---|
| $NaNO_3$ | 55.1 | 20.1 |
| $Al(NO_3)_3.9H_2O$ | 243.6 | 33.1 |
| $Zn(NO_3)_2.6H_2O$ | 91.4 | 25.0 |
| $Ca(NO_3)_2.4H_2O$ | 170.1 | 40.4 |
| $LiNO_3$ | 91.4 | 19.8 |
| $ZrO.(NO_3)_2.2H_2O$ | 11.7 | 5.4 |

The matrix will be completed using:

as the source of silicia: Ludox AS40 as the source of boron: a boric acid solution containing 130.5 g per 1000 g of water, kept at 60° C.

The following flow rates are delivered simultaneously to the turbine with three pumps:

solution of vitrification adjuvant: 5 kg/h solution of Ludox: 9.5 kg/h solution of boric acid: 5.8 kg/h Practically 20 kg of a gel are recovered in one hour; this is dried on a plate in an oven at 100°-105° C. and then calcined at 400° C. (with gradual increase in temperature and a plateau at 200° C.). This gives a solid mass composed of irregular pieces of a few $cm^3$. These are ground to a uniform size and sieved with a 2.5 mm mesh.

Analysis of this calcined product gives:

| | |
|---|---|
| $SiO_2$ | 61.6 (% by weight) |
| $B_2O_3$ | 19 (% by weight) |
| $Na_2O$ | 2.7 (% by weight) |
| $Al_2O_3$ | 4.5 (% by weight) |
| ZnO | 3.4 (% by weight) |

-continued

| | |
|---|---|
| CaO | 5.5 (% by weight) |
| $Li_2O$ | 0.75 (% by weight) |

This analysis can be seen to be very similar to the formulations of the typical frit used in the AVM process as regards all the constituents except sodium.

The ratio of silica to boric oxide is equal to 3.244 in the theoretical formula and 3.242 in the calcined gel.

The ratio of silicia to alumina is equal to 13.75 in the theoretical formulation and 13.69 in the calcined gel.

By contrast, the ratio of silica to sodium is equal to 8.407 in the theoretical formulation and 22.82 in the calcined gel.

The sodium level is 7% in the theoretical formula and 2.7% in the calcined gel.

Thus, a mixture of solution of FP+soda effluent can be treated by vitrification while preserving a normal sodium level for the final glass, as shown in the remainder of the example.

2500 g of a solution of sodium nitrate containing 100 g/kg, simulating the soda effluent, are added to 10 liters of the solution simulating the FP (as described in Example 1). (Sodium nitrate is used because the solution simulating the FP contains no free nitric acid, which is unrealistic.)

The mixture is dried at 105° C. on a plate in an oven and then calcined at 400° C. in a small furnace to give a powder consisting of grains of a few millimeters, which represent the calcinate of (FP+soda effluent) and which we will refer to as the calcinate.

375 g of the said calcinate are carefully mixed dry with 1000 g of the calcined gel.

The mixture is introduced in several portions into a crucible placed in a furnace regulated at 1100° C. Complete melting in 5 hours is followed by pouring. Very slight marbling is observed on the surface, which undoubtedly corresponds to traces of molybdate but is entirely acceptable.

Analysis shows that the glass contains 10.2% of $Na_2O$ for 46% of silica, i.e. a ratio of silica to sodium of 4.5, whereas this ratio is equal to 4.56 in the typical formulation of the final glass.

This example demonstrates the possibility of producing, as required, a calcined gel having a composition which is difficult to obtain in the form of a glass frit, and in particular the possibility of producing a low-sodium calcined gel which enables the solution of FP and the soda effluent to be vitrified at the same time.

Example 4

This is an attempt to prepare 1 kg of glass immobilizing radioactive waste (solutions of FP), using an inactive matrix of the following composition:

| | |
|---|---|
| $SiO_2$ | 63.4% |
| $B_2O_3$ | 22.7% |
| $Na_2O$ | 11.3% |
| $Li_2O$ | 2.6% |

This matrix is prepared by mixing the following solutions in a turbine:

(1) Ludox AS40 at 65° C., 1150 g (2) $ATB.9H_2O$ at 65° C. in solution at the saturation limit (about 40 g/100 g of water), 312 g (3) a solution of vitrification adjuvant practically saturated with lithium and sodium nitrates at 65° C., containing 225 g of $NaNO_3$ and 87.5 g of $LiNO_3$ in 250 g of water.

This gives a gelled solution which changes to a gel and is dried at 150° C. for 24 h.

The solution of FP to be treated in this example is simulated by dissolving the following compounds in 1400 g of water:

| | |
|---|---|
| $Sr(NO_3)_2$ | 6.7 g |
| $ZrO(NO_3)_2.2H_2O$ | 29.3 g |
| $Mn(NO_3)_2.4H_2O$ | 30.3 g |
| Mo | 11.3 g |
| Te | 1.4 g |
| $CsNO_3$ | 13.1 g |
| $Ba(NO_3)2$ | 8.7 g |
| $Y(NO_3)_3.6H_2O$ | 4.3 g |
| $La(NO_3)_3.6H_2O$ | 23.9 g |
| $Ce(NO_3)_3.6H_2O$ | 25.1 g |
| $Pr(NO_3)_3.4H_2O$ | 12.3 g |
| $Nd(NO_3)_3.6H_2O$ | 45.6 g |
| $Fe(NO_3)_3.9H_2O$ | 151.8 g |
| $Al(NO_3)_3.9H_2O$ | 448.5 g |
| $Mg(NO_3)_2.6H_2O$ | 356.1 g |
| $Cr(NO_3)_3.9H_2O$ | 21.1 g |
| $Ni(NO_3)_2.6H_2O$ | 17.1 g |
| $LiNO_3$ | 87.5 g |

240 g of commerical nitric acid (65% by weight) are added to this solution.

The solution obtained is stirred for 1 hour, then dried for 24 hours at about 150° C. and then calcined for 4 hours at about 400° C.

The resulting calcinate of FP and dried gel are then introduced simultaneously into a crucible. The mixture is melted at 1025° C. for 5 hours.

The glass obtained has the following composition:

| | | | |
|---|---|---|---|
| $SiO_2$ | 46% | $Cs_2O$ | 0.95% |
| $B_2O_3$ | 16.5% | BaO | 0.51% |
| $Na_2O$ | 8.2% | $Y_2O_3$ | 0.14% |
| $Li_2O$ | 3.8% | $La_2O_3$ | 0.90% |
| SrO | 0.33% | $Ce_2O_3$ | 0.95% |
| $ZrO_2$ | 1.35% | $Pr_6O_{11}$ | 0.51% |
| $MnO_2$ | 1.05% | $Nd_2O_3$ | 1.75% |
| $MoO_3$ | 1.7% | $Fe_2O_3$ | 3% |
| $TeO_2$ | 0.17% | $Al_2O_3$ | 6.1% |
| NiO | 0.44% | MgO | 5.6% |
| | | $Cr_2O_3$ | 0.4% |

This glass shows no precipitates or traces of molybdate on the surface.

In the tests described, concentrated solutions were prepared (some even being close to saturation point) so as not to increase the drying times or the volumes of liquid to be handled. For reasons of pumping and flows in particular, it may be necessary to dilute these solutions more, but this has no adverse effect on the process.

The process developed by the Applicant Company therefore differs from the processes described previously, especially the Westinghouse process.

The Applicant Company considers that it has succeeded in preparing, in an aqueous medium, a borosilicate matrix which is ready to be employed for the treatment of nuclear waste, by virtue of the solutions and stirring method used.

Stirring at a high rate of shear makes it possible to achieve thixotropic mixing and homogeneity. As soon as stirring stops, the viscosity increases and polymerization rapidly develops, thus "freezing" the ions before they can react (for example precipitation, sedimentation).

The process forming the subject of the invention offers an important advantage when operated industrially in a nuclear environment: the matrix is prepared in an inactive environment, so the whole of this part of the process is not subject to the rigid and essential constraints to be observed in an active environment, and the technologies conventionally used in the chemical industry can be employed without modification.

Furthermore, the second part of the process (heat treatment with introduction of the waste) can utilize, practically without modification, the existing production lines which are already installed and work with the oxides.

What is claimed is:

1. A process for the preparation of a borosilicate glass containing nuclear waste, wherein The process comprises the steps of:

(A) mixing
  1. an inactive borosilicate matrix prepared in an aqueous medium by mixing the following:
  2. a silica-based gel precursor,
  3. a concentrated aqueous solution of a boron compound, and
  4. a concentrated aqueous solution of a vitrification adjuvant, with stirring at a high rate of shear, at a temperature of between 20° C. and 80° C. and at an acid pH, so as to form a gel;

(B) drying the gel to provide a dried gel;

(C) calcining the dried gel to form a calcined material;

(D) melting the calcinated material to form a melted glass;

(E) solidifying the melted glass; and (F) adding an aqueous solution of nuclear waste or a calcinate thereof to the gel during one of the steps (B), (C) and (D) to form the borosilicate glass immobilizing the nuclear waste.

2. the process as claimed in claim 1, wherein the mixture to prepare the inactive matrix is effected with a stirrer which rotates at more than about 500 rpm.

3. The process as claimed in claim 2, wherein the mixing is done at about 65° C. to 70° C.

4. The process as claimed in claim 1, wherein the gel precursor is a sol.

5. The process as claimed in claim 1, wherein the silicon-based gel precursor is an alkaline colloidal silica.

6. The process as claimed in claim 1, wherein the silicon-based gel precursor is an acid colloidal silica.

7. The process as claimed in claim 1, wherein the boron compound is ammonium tetraborate.

8. The process as claimed in claim 1, wherein the boron compound is boric acid.

9. The process as claimed in claim 1, wherein the inactive matrix is dried at between 100° and 200° C., and then calcined at between 300° and 450° C. to provide a calcinate, wherein the said calcinate is dispersed in the aqueous solution of nuclear waste and mixed by stirring, and wherein the resultant mixture is dried, calcined and then melted to form the final glass.

10. The process as claimed in claim 1, wherein the inactive matrix is dried at between about 100°-105° C., wherein the said dried gel is brought into contact with the aqueous solution of waste, with stirring, and wherein the resultant mixture is dried, calcined and then melted to form the final glass.

11. The process as claimed in claim 9, wherein the dried or calcined matrix and the solution of waste are introduced separately into a calciner, and wherein the mixing, drying and calcination are effected in the said calciner.

12. The process as claimed in claim 1, wherein the solution of waste is dried or calcined and the dried waste or calcinate of the waste is introduced separately into a melting furnace to form the final glass.

13. A process for immobilizing nuclear waste in the form of a liquid aqueous solution as a waste material, the process comprising the steps of:

A. simultaneously mixing glass-forming materials in an aqueous system, the ingredients comprising:
  1. a silica gel precursor for forming silica in the final glass, the precursor being an aqueous suspension of colloidal silica;
  2. a boron compound in an aqueous solution for forming boron oxide in the final glass; and
  3. an aqueous solution of vitrification adjuvant, the mixing being done at an acid pH and a temperature of about 20° to 80° C. to provide a gel solidified material;

B. drying the resultant solidified material to provide a dried gel;

C. calcining the dried gel of Step B at a temperature of about 300° to 500° C.;

D. melting the calcined product of Step C to form a melted glass;

E. solidifying the melted glass to form a borosilicate glass that encapsulates a nuclear waste material; and F. adding an aqueous solution of nuclear waste or a calcinate of the aqueous solution of the nuclear waste to the dried material of step B or the calcined product of step C or the melted product of step D to provide the immobilized waste product.

14. A process as defined in claim 13 in which other constitutents of the final glass as a vitrification adjuvant are added in Step A, the adding being simultaneous with the glass forming materials, the other constituents comprising a solution of an aluminum compound that forms $Al_2O_3$ in the final glass.

15. A process as defined in claim 14 in which the other constituents comprises solutions of glass-forming compounds that form $Na_2O$, ZnO, CaO and $ZrO_2$ in the final glass.

16. A process as defined in claim 13 in which Step A is performed at about 65° to 70° C.

17. A process as defined in claim 16 in which the aqueous system of Step A has a pH of about 2.5 to 3.5.

18. A process as defined in claim 13 in which the drying Step B is about 100° to 105° C.

19. A process as defined in claim 13 in which Step C is conducted at about 300° to 450° C.

20. A process as defined in claim 13 in which the silica gel precursor is an alkaline colloidal silica that provides a gel to provide the gel solidified mixture of Step A.

21. A process as defined in claim 13 in which the aqueous solution of 1 and 2 in Step A are concentrated in which the solutions are at least about 75% of their saturation concentrations.

* * * * *